US010147290B2

(12) United States Patent
Green et al.

(10) Patent No.: US 10,147,290 B2
(45) Date of Patent: Dec. 4, 2018

(54) TENT ALARM SYSTEM

(71) Applicants: Andre Green, Pittsburgh, PA (US); De'Andre Isaiah Green, Pittsburgh, PA (US)

(72) Inventors: Andre Green, Pittsburgh, PA (US); De'Andre Isaiah Green, Pittsburgh, PA (US)

( * ) Notice: Subject to any disclaimer, the term of this patent is extended or adjusted under 35 U.S.C. 154(b) by 0 days.

(21) Appl. No.: 14/957,333

(22) Filed: Dec. 2, 2015

(65) Prior Publication Data

US 2016/0328931 A1 Nov. 10, 2016

Related U.S. Application Data

(60) Provisional application No. 62/157,122, filed on May 5, 2015.

(51) Int. Cl.
*G08B 15/00* (2006.01)
*G08B 13/12* (2006.01)

(52) U.S. Cl.
CPC ..... *G08B 15/00* (2013.01); *G08B 13/122* (2013.01); *G08B 15/005* (2013.01)

(58) Field of Classification Search
CPC ..... G08B 13/02; G08B 15/02
See application file for complete search history.

(56) References Cited

U.S. PATENT DOCUMENTS 4,982,645 A * 1/1991 Abboud ..... F41B 15/04 42/1.08
5,019,802 A * 5/1991 Brittain ..... G08B 13/2494 340/506
5,188,362 A * 2/1993 Ashihara ..... F41B 15/025 463/47.6
5,607,090 A * 3/1997 Brown ..... A45C 1/04 222/175
5,888,137 A * 3/1999 Bukle ..... F41B 15/02 463/47.2
D413,780 S * 9/1999 Beam ..... D8/75
6,404,613 B1 * 6/2002 Dowling ..... A22B 3/06 361/232

(Continued)

OTHER PUBLICATIONS

Robert Coltman Clephan, The Defensive Armour and the Weapons and Engines of War of Medival Times, W. Scott, limited, 1900—Armor—237 pages total, pp. 161, 196, 197, 201, and 202 cited and included herewith.*

(Continued)

*Primary Examiner* — Erin F Heard
(74) *Attorney, Agent, or Firm* — Gary P. Topolosky

(57) ABSTRACT

An alarm system for protecting an occupant of an outdoor tent, warning the occupant of an approaching animal and serving as a defensive weapon against the animal. The alarm system comprises a plurality of individual alarms for positioning about a perimeter of the outdoor tent, each alarm being situated in a stand or a section of ground near the outdoor tent. Each individual alarm comprises a support post onto which a detector component is situated, said detector component including a motion sensor element, a sound speaker for playing a recorded alarm upon activation, a battery powered light element, and an on-off switch that connects to a remote control unit for the alarm.

10 Claims, 6 Drawing Sheets

(56) References Cited

U.S. PATENT DOCUMENTS 7,044,858 B1* 5/2006 Otto ..... F41B 15/022 463/47.2
7,082,954 B1* 8/2006 Flanery ..... E04H 15/62 135/118
7,950,176 B1* 5/2011 Nemtyshkin ..... F41H 13/0025 361/232
2003/0109315 A1* 6/2003 Bunting ..... F41B 15/08 463/47.2
2006/0090605 A1* 5/2006 Fisher ..... B25D 1/045 81/25
2008/0157983 A1* 7/2008 Dir ..... A01K 97/125 340/573.2
2011/0080292 A1* 4/2011 Tomoda ..... G08B 7/00 340/573.1
2011/0091069 A1* 4/2011 Anabuki ..... G06K 9/00295 382/103
2011/0311077 A1* 12/2011 Quiroga Cordoba .... G08B 3/10 381/150
2012/0292353 A1* 11/2012 Andersen ..... A45F 3/06 224/149
2013/0176711 A1* 7/2013 Bushee ..... F21V 33/0076 362/102
2014/0334058 A1* 11/2014 Galvan ..... F41H 13/0025 361/232
2014/0379292 A1* 12/2014 Ara ..... A61B 5/11 702/141
2015/0198939 A1* 7/2015 Ander ..... G05B 15/02 700/83
2015/0243144 A1* 8/2015 Cantave ..... G08B 13/2491 340/541
2016/0037131 A1* 2/2016 Burnett ..... G08B 13/08 348/152
2016/0116343 A1* 4/2016 Dixon ..... G01J 1/44 250/342
2016/0189496 A1* 6/2016 Modi ..... G08B 13/08 340/545.2
2016/0189531 A1* 6/2016 Modi ..... G08B 29/185 340/506

OTHER PUBLICATIONS

Robert Coltman Clephan, The Defensive Armour and the Weapons and Engines of War of Medival Times, 1900, London: Walter Scott, Limited, Paternoster Square.*

* cited by examiner

TENT ALARM SYSTEM

CROSS-REFERENCE TO RELATED APPLICATION

This is a perfection of U.S. Provisional Application No. 62/157,122, filed on May 5, 2015, the disclosure of which is fully incorporated by reference herein.

BACKGROUND OF THE INVENTION

This invention relates to an alarm system for protecting outdoor campers. More particularly, it relates to a system of various tent alarms for placing about the perimeter of a campground. The invention consists of five distinct models which can be used interchangeably . . . each can be situated at the four corners of a campsite with a fifth as a spare near the tent's main entrance. Or, the same model (one of the five) can be located at each of the four corners. Alternately, they can be arranged in pairs or various other sets of two, three or four.

The Tent Alarm™ of this invention may save a life by alerting campers when people or animals come around their tent or camping area. It is sufficiently loud so as to cause an attacker (human or animal) to retreat. A user merely hammers the various models (one of the five) at or near the four main corners of the tent exterior/campsite with a fifth unit either inside the tent proper or immediately outside the tent's opening. And, when needed in the event of an emergency, any one of these models can be rapidly pulled from the ground and swung about for protection. In another alternative embodiment, the corner post alarm unit can either resemble, or merely serve to operate as, the ancient weapon known as a flail for grabbing by the elongate handle and swinging about with an upper pointed stick or ball component.

When people or animals approach the secured tent alarm perimeter, the alarm's sound sensor and/or light (strobe or full on) will go off alerting those within the tent of potential human or animal intruders.

Every lightweight model of this tent alarm will be waterproof and have a motion-activated light, a sound alarm that resembles a shotgun blast, a siren, a wild animal noise (like the roar of a wildcat, bear, etc.), an airhorn and/or loud car horn.

Each model will be battery-powered by one or more battery units stored inside. These battery units will be rapidly rechargeable and, ideally, carry enough back up power for lasting through the night. With extra charging capabilities, each unit can be optionally fitted with a slight taser-like contacting post for use when an intruder gets too close to one's personal space.

Each model of tent alarm is on a hammerable stake that, when duly installed, will rest at about knee height or no more than 18-24 inches above ground. Optional models would include a height-extendable version that, when locked into place, could raise (or lower) the overall height of each stake unit another 6 to 18 inches. The top to said stakes can be driven into the ground adjacent the camp tent with a hammer, mallet or possibly by using a hammer-like end to one of the other alarm posts. Alternately, each of the respective alarm units may be held in place using a wooden log (or stone) alarm holder placed, and well anchored, at the respective corners of one's campground.

Unlike the tent alarm system of Chinese Patent No. 203239041, each model of this Tent Alarm can be quickly pulled from the ground to further serve as a defense weapon . . . in a "pinch". With its upper head handle, any model can be pulled out and swung about for scaring away animals. When people approach (or wild animals wander too close), the lights of an alarm will come on and the sounds for that alarm go off.

The respective alarms can be wired to individual remote controls, or to one common remote control that can turn the whole system on or off from within the tent proper. In addition, preferred embodiments would include a timer mechanism (for the universal remote, OR for each individual alarm model). That timer would allow its user to set the system's alarm and then return to the centralized tent, or leave the campground (temporarily, perhaps for hunting/hiking, etc.), before eventually returning to the secured area. Such a timer could be set at staggered intervals, such as 1, 2 or 5 minutes, or possibly even longer (as needed).

The respective models will be lightweight, yet able to be used for defensive purposes as well. An optional variation would include a built in, replaceable spray canister in which can be stored an easily directed stream of mace, pepper spray or other irritant.

BRIEF DESCRIPTION OF THE DRAWINGS

Referring to the accompanying drawings, there is shown.

DESCRIPTION OF PREFERRED EMBODIMENTS

The types of wildlife animals this invention is designed to protect campers from include: bears, raccoons, opossum, skunks, porcupines, etc. It may also ward off surprise visits from wandering humans. It is motion activated and meant to provide its users with some advance warning of an approaching, potential predator or mammal that might otherwise inflict harm on the tent occupants.

Ideally, each alarm model of this invention would further include refillable, reloadable canisters of safety spray protections, such as mace or hot pepper spray, that can be directed and launched at a target from a safe enough distance.

Preferred materials for the main alarm components are lightweight steels and/or aluminum . . . or perhaps a hard enough plastic/composite for accepting numerous hammerings into the ground of a tent/campsite yet serve as a viable weapon for striking at an animal in an emergency.

Referring now to the FIGS., there is shown a first embodiment of the system of this invention that employs around a representative camping tent T one of each of the four main alarms at the four corners surrounding tent T. Particularly, there is a hammer style alarm 10 at the lower left quadrant/corner of the campground for tent T, a spiked ball and chain model alarm 20 in the upper left corner, a spiked club alarm 30 in the lower right corner and a fourth model, the representative dual axe head alarm 40 above spiked club alarm 30 and in the rear of tent T.

Figure 2:
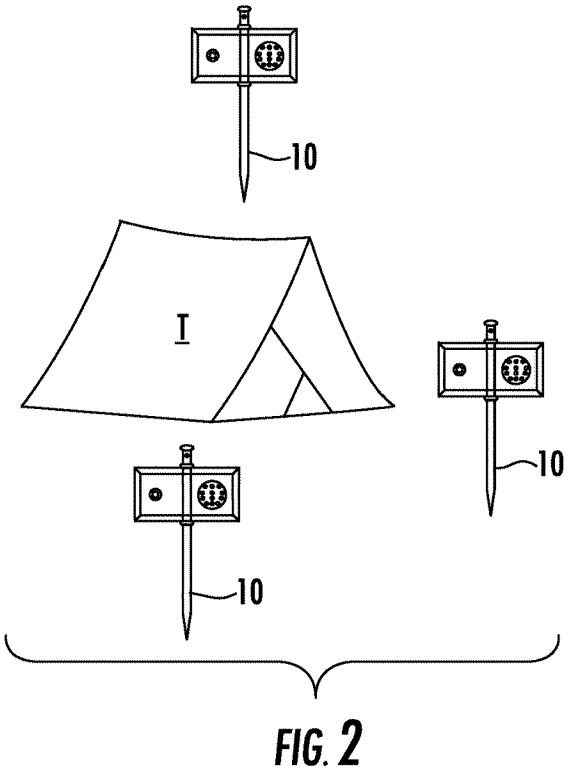
FIG. 2 is a perspective view showing use of just the main, hammer alarm situated at the four corners of an erected camp tent.

FIG. 2 shows an alternate arrangement in which four units of the same alarm model, in this case hammer style model 10 are positioned about the perimeter points of that tent T. It is to be understood, however, that the alarms are to be sold for individual uses, all in one common alarm set or in sets with multiple combinations of units.

Figure 1:
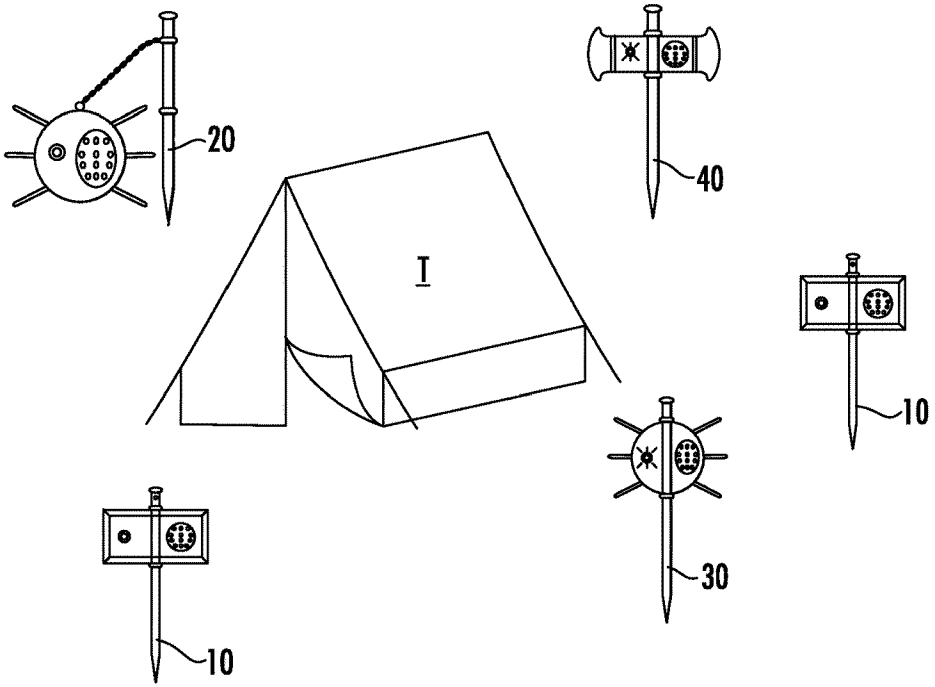
FIG. 1 is a perspective view showing the four main models of tent alarms at the four corners surrounding a camp tent.

Common elements in the respective detailed views of each main alarm model are commonly numbered in remaining views, FIGS. 3 through 6 (for the four models shown in FIG. 1). Yet another variation of sword-like alarm model has been separately shown in accompanying FIG. 7.

Figure 3:
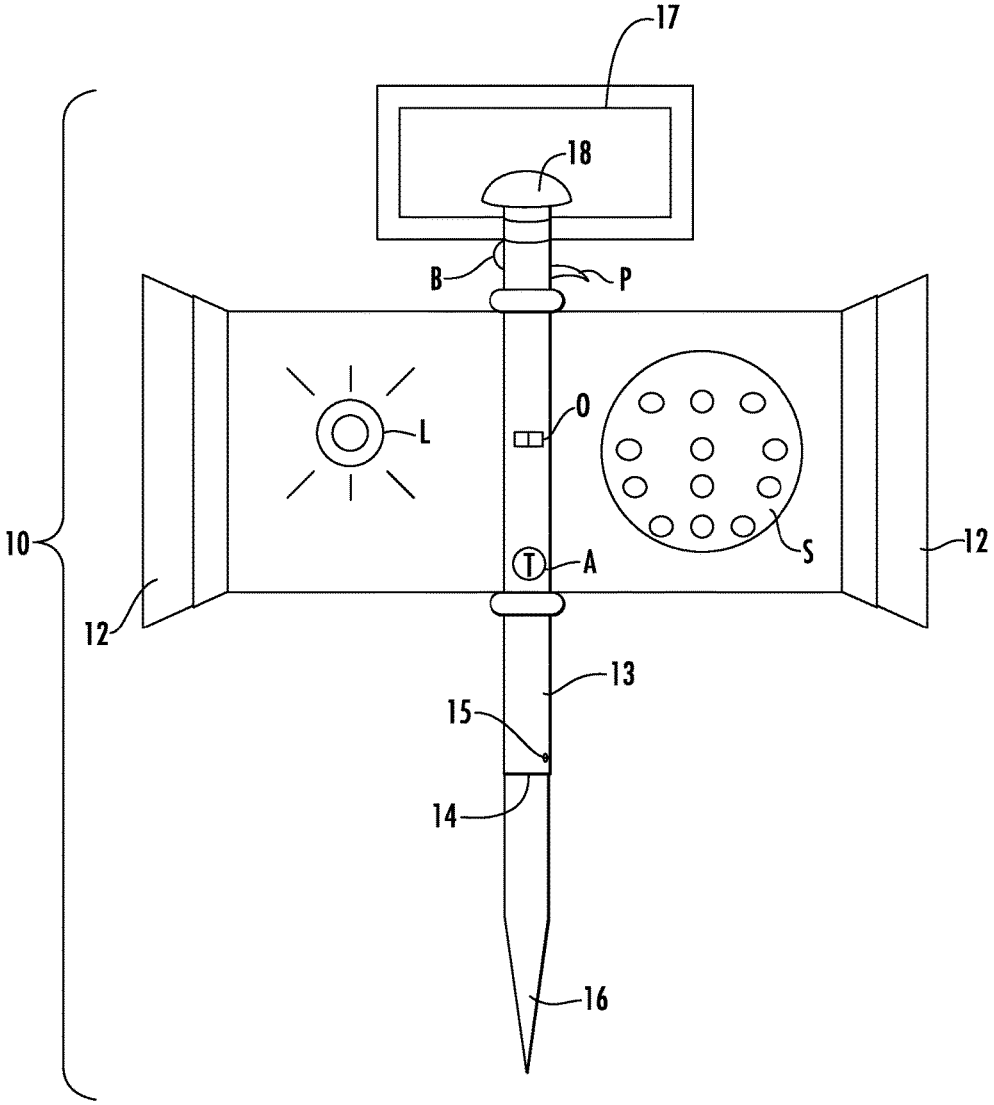
FIG. 3 is a front plan view showing the dual hammerhead model of tent alarm with its taser trigger, extendible post, sound and light warning components, on-off switch and timer.

The first preferred model of tent alarm, element 10 in FIG. 3, consists of a dual headed hammer 11, with rubber mallet end caps 12. A central support post 13 extends midway between hammer-heads 11. Note, that it preferably contains an internal extension component 14 that locks into place via button 15 before terminating in a lower spike tip 16. At the opposite end of support post 14, there is shown a pull out handle 17, in this case shaped as a rectangular pull. The latter protects an upper hammer cap 18 for use during installation of the alarm unit 10 by hammering into the ground.

Like all other alarm models, each unit minimally includes a sound speaker S on one side of hammerhead 11 for model 10 of FIG. 3 with an LED, bright light L (strobe, optional) adjacent sound speaker S. In this instance, the bright light L and speaker S are separated by support post 13. Also, each alarm model will have its own On/Off Switch O nearest a central power unit, battery pack, etc. (not shown). Near to the On/Off Switch O, there should be located a timer adjustment A for allowing a controlled to set each alarm before exiting the area (either going into the tent T for the evening or leaving the campsite for a possible nearby activity such as hunting, fishing or hiking) On some models, there is further included a taser activation button B which, when duly charged, can be used as a last resort to "zap" or shock a predator (human or animal). The latter unit will require greater power charging capabilities and should further alert its user WHEN a sufficient upcharge has been achieved, either by sound, light notification or both.

Yet another alternative/option would be the inclusion in the body proper of alarm 10, a canister of mace, pepper spray or other liquid/gaseous irritant in a replaceable/refillable container. While its canister is not visible in FIG. 3 as shown, the pull trigger P for activating such spray dispensing is near the top region of support post 13, closest to hammer cap 18.

Figure 4:
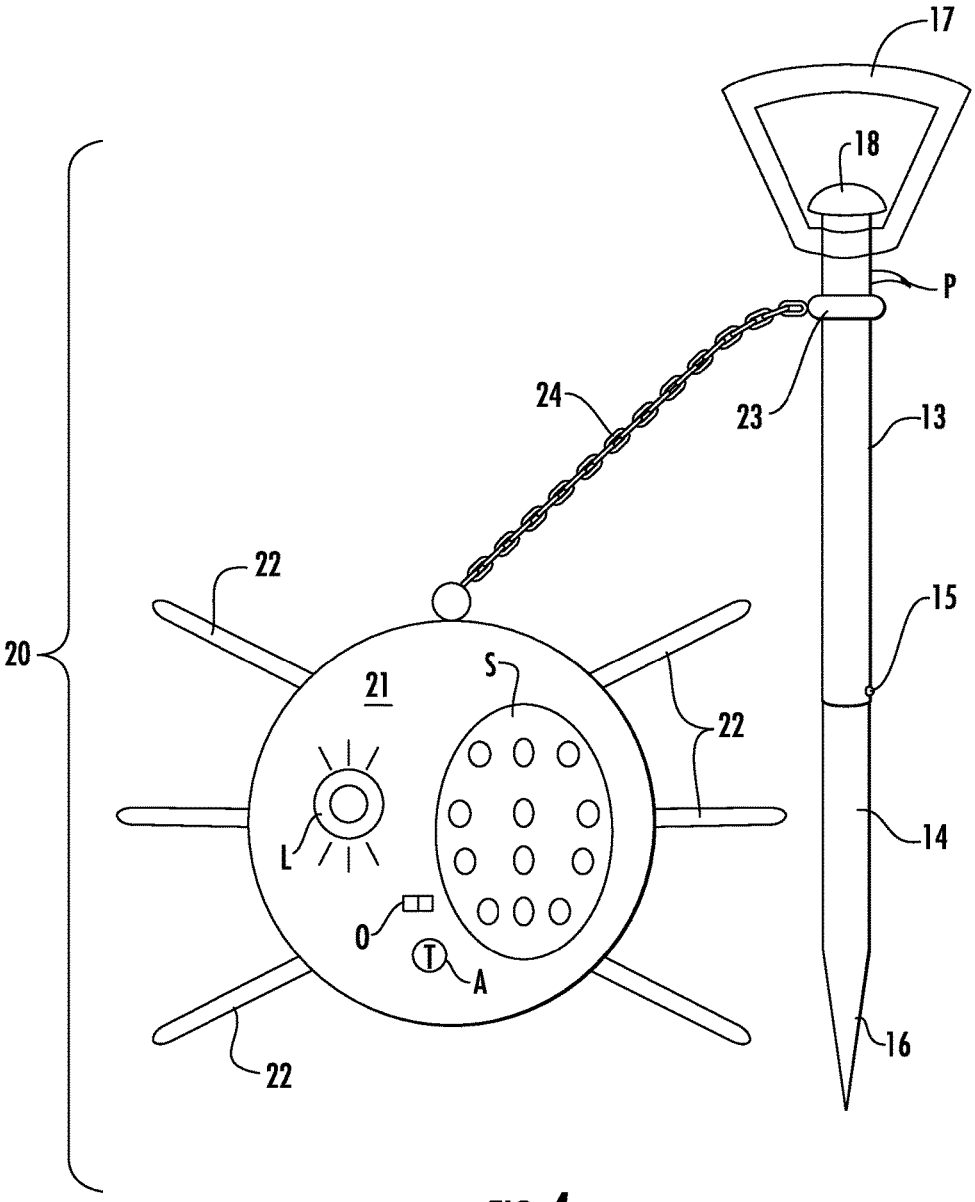
FIG. 4 is a front plan view showing the spiked ball and chain model of tent alarm with its extendible post, sound and light warning components, on-off switch and timer.

The first alternate alarm embodiment at FIG. 4, generally element 20, shows a large central ball 21 having a plurality of spikes 22 extending from one or more sides. As shown, six representative spikes extend, three from each hemisphere of ball 21 with the latter being connected to a collar 23 on support post 13 via swinging chain 24. FIG. 4 also differs in general appearance from the dual hammer configuration at FIG. 3 in that a representative triangular shaped pull handle 17 has been substituted for the initial rectangular variation. Needless to say, any of the models of tent alarms for this invention should be easily fitted with one (or more) of the various pull handle configurations depicted herein.

Figure 5:
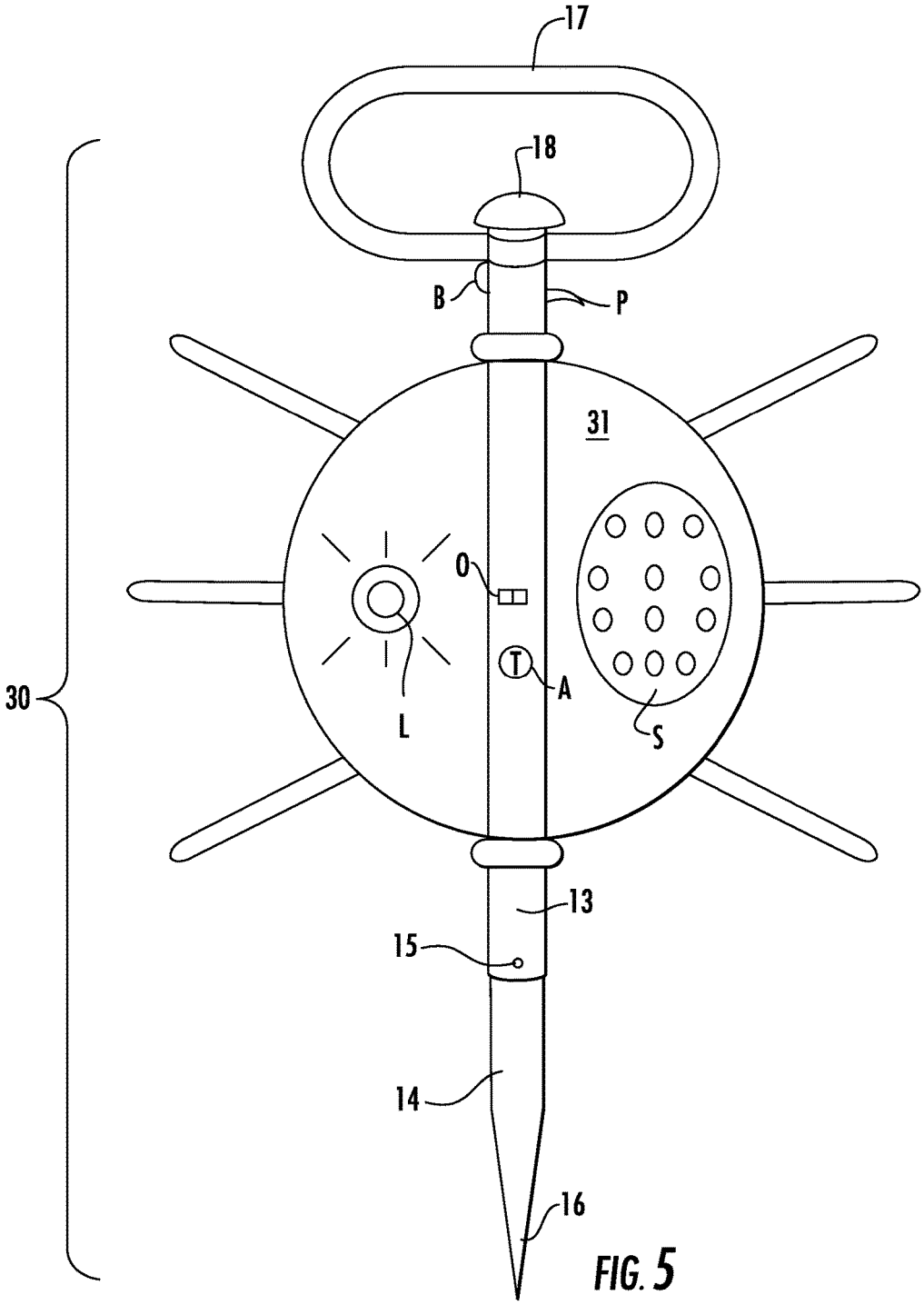
FIG. 5 a front plan view showing the spiked club model of tent alarm with its taser trigger, extendible post, sound and light warning components, on-off switch and timer.

The second alternative variation of tent alarm 30, per FIG. 5, includes a centralized club or clubface component 31 (as compared to the spiked ball section of FIG. 4). A plurality of spikes 32 (six are shown) extends from opposed sides of club 31. Though not visible in this view, additional rows or sections of spikes may further protrude from a rear face of club 31. In addition to the different defensive weaponry depicted, second alarm 30 differs from its two predecessor models with the inclusion of an oval-shaped handle 17 atop its central support post 13.

Figure 6:
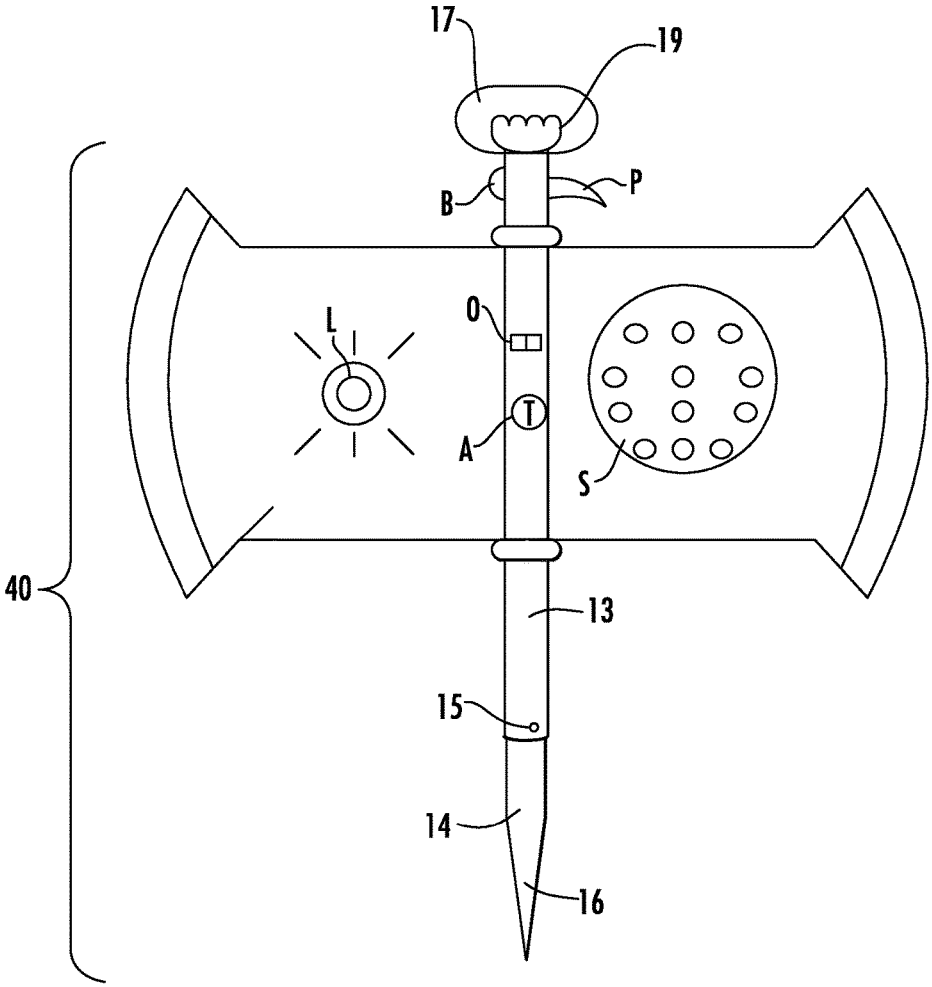
FIG. 6 a front plan view showing the dual axe head model of tent alarm with its taser trigger, extendible post, sound and light warning components, on-off switch and timer.

The dual axe head alarm 40 of FIG. 6 includes on either end of central portion 41 a curved axe-face 41. Ideally, the outer edge to axe-face 41 is not unduly sharpened so as to possibly injure innocently passing by humans and/or pets but could still inflict injury in a defensive posture when pulled from the ground and swung about in case of an emergency. Note that for this third alternative alarm design, yet another pull handle top 17 is depicted. In this case, top 17 is an enlarged, hammerable knob with a plurality of grooved, finger-shaped gripper point thereunder from which a user could position his/her hand for yanking the alarm up and out of the ground: (a) in the event of an emergency; and/or (b) when breaking camp and getting ready to leave the campsite for a return trip home.

Figure 7:
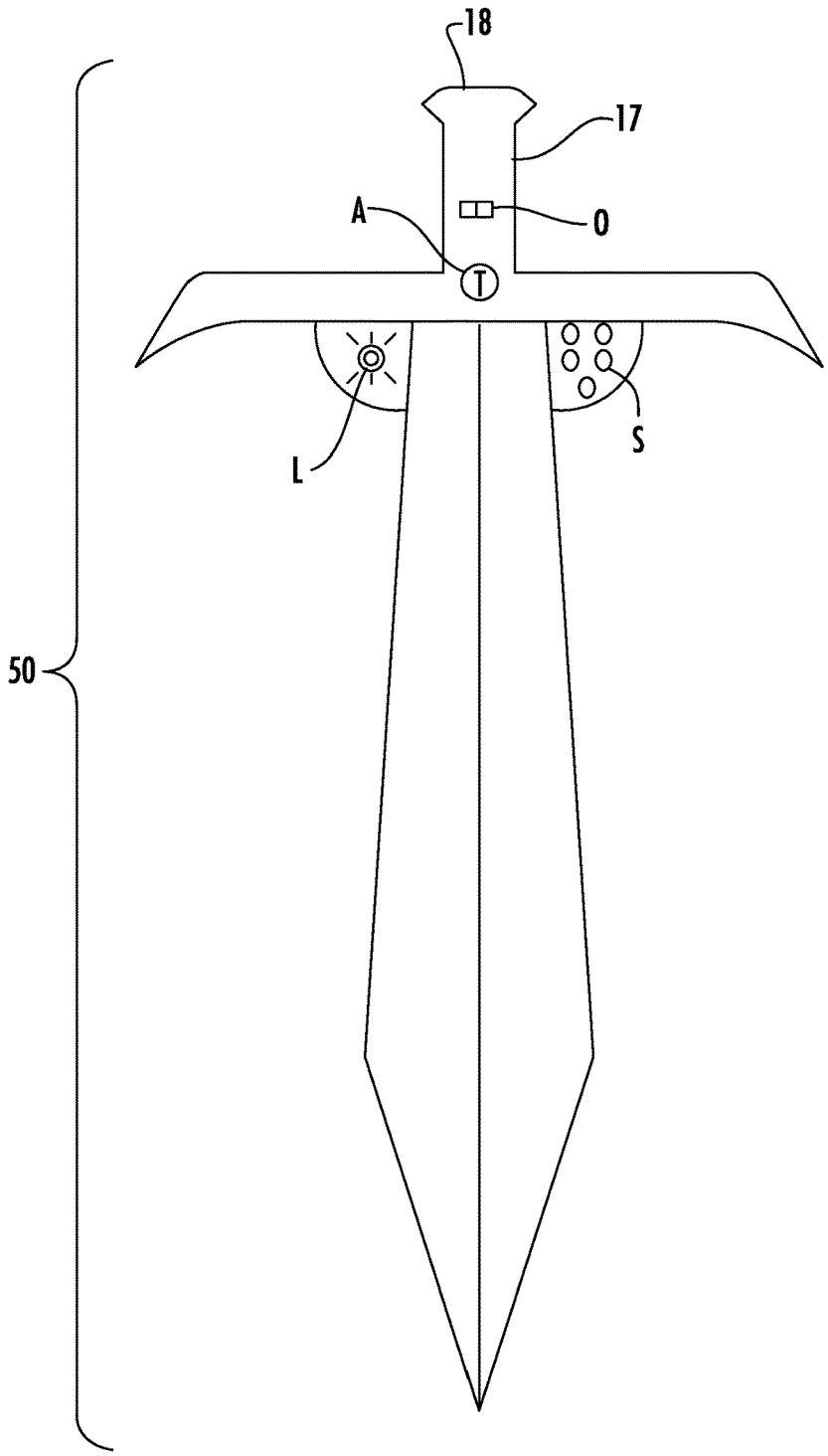
FIG. 7 a front plan view showing the sword-shaped model of tent alarm with its sound and light warning components, on-off switch and timer.

The fourth alternative tent alarm depicted, but not shown in earlier FIG. 1 is the sword-like variation of FIG. 7, generally element 50. It includes a long central blade 53 (rather than a singular support post) with a fully operational pull handle 17 extending thereabove. The base to that pull handle 17, especially when made as a single unit, can extend substantially perpendicular to the main blade element of this sword-like alarm model alternative. And the unit, as a whole, can be hammered into the ground (or other alarm support) by simply hammering onto the top of hammer cap 18.

For the installation of these various alarm units, regions about the camp's tent T can be identified and, using a mallet/hammer or possibly a hammerable end cap to another alarm unit, the respective alarm units can be hammered into place into the ground proper (or, alternatively, into a separate set of wooden log or stone set holders. In some instances, it may prove beneficial to further extend the lengths of various center support posts to create a longer reach, higher resting alarm post and then locking that extension in place through the manipulation of each respective lock button.

When the alarm units are all installed and in place, a common remote programmed for all of the models, or the remote for each of the installed alarms can then be touch activated to turn them all "ON". Alternately, the ON/OFF button for each fully charged alarm unit can be manually activated at or near the respective model handles. If need be, a timer can be preset to allow for a convenience "escape" time before full PROTECTION mode commences. This timed delay would let the tent occupiers enter their premises for the evening without fear of self-activation by their movements outside the tent proper.

Once fully armed, the movement of any intruder near a particular alarm model should trigger its sound and/or lights to go off with the corresponding noises (see the various settings considered above) scaring away the unwanted "guest", man OR beast. The bright lights should also serve as means for alighting a safe field for scaring away a non-human intruder and/or letting the system's owner quickly determine the "situation" for reacting accordingly. Should there be a need to take a defensive posture against any such animal, the user can quickly yank on the top handle to the nearest alarm, pull it out of the ground and proceed to swing it about in defense of the tent and its authorized occupants.

Should the optional features be needed, the same user could pull a trigger activating a mace or pepper spray from within the alarm handle to aim at and inflict on the intruding beast. Should they be already near enough for physical contacting, the taser button can be held, charging up the whole unit and then used to zap (or otherwise shock) away the undesired camp "visitors".

The preferred forms of the invention described above are to be used as illustration only, and should not be utilized in a limiting sense in interpreting the scope of the present invention. Modifications to these exemplary embodiments can be made by those skilled in the art without departing from the spirit of this invention.

What is claimed is:

1. A mobile alarm system for protecting an occupant of an outdoor tent, said alarm system intended for: (a) being installed into a section of ground about a perimeter of the outdoor tent and left in the section of ground unless needed for easy removal and swinging about as a defensive weapon; (b) sensing when an animal is approaching the outdoor tent; (c) providing a light alarm and an audible warning to signal that the animal is continuing to approach the outdoor tent; and (d) being easily removed from the section of ground and swung about as the defensive weapon should the animal not be deterred by the light alarm or the audible warning and continue approaching the outdoor tent, said alarm system comprising:

a plurality of individual alarm units, each individual alarm unit being at least partially inserted into the section of ground about the perimeter of the outdoor tent and comprising:

a support post with a handle component and a detector component, each detector component including:

a motion sensor element, a sound speaker for playing the audible warning when the animal approaches the motion sensor element for that individual alarm unit, a battery powered light element for signaling the light alarm when the animal approaches the motion sensor element for that individual alarm unit, and an on-off switch that connects to a remote control unit for activating one or more of the individual alarm units, said support post adapted for being easily removed from the section of ground and swung about by the handle component as a defensive weapon should the animal not be deterred by the audible warning or the light alarm.

2. The alarm system of claim 1 wherein each alarm unit further includes a refillable container for a spray or liquid irritant and a trigger for controlling dispensing of the irritant from the container.

3. The alarm system of claim 2 wherein the irritant is mace or pepper spray.

4. The alarm system of claim 1 wherein one or more alarm units further includes:

an electric charging element; and a button for delivering a shock charge from the electric charging element.

5. The alarm system of claim 1 wherein the audible warning is selected from the group consisting of a gunshot, a loud horn, a siren and a wild animal roar.

6. The alarm system of claim 1 wherein the detector component includes a hammer mallet at opposed ends.

7. The alarm system of claim 1 wherein the detector component includes a spiked ball and chain component.

8. The alarm system of claim 1 wherein the detector component includes a spiked club component.

9. The alarm system of claim 1 wherein the detector component includes an axe head at opposed ends.

10. The alarm system of claim 1 wherein the detector component includes a sword with cross-handle component.

* * * * *